US010654694B2

(12) United States Patent
Holly

(10) Patent No.: US 10,654,694 B2
(45) Date of Patent: May 19, 2020

(54) CYLINDER RETENTION DEVICE

(71) Applicant: Manitowoc Crane Companies, LLC, Manitowoc, WI (US)

(72) Inventor: Nathan P. Holly, New Franken, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 0 days.

(21) Appl. No.: 16/219,628

(22) Filed: Dec. 13, 2018

(65) Prior Publication Data

US 2019/0135592 A1 May 9, 2019

Related U.S. Application Data

(62) Division of application No. 15/083,455, filed on Mar. 29, 2016, now Pat. No. 10,183,847.

(60) Provisional application No. 62/140,852, filed on Mar. 31, 2015.

(51) Int. Cl.
*B66C 23/70* (2006.01)
*B66C 23/82* (2006.01)

(52) U.S. Cl.
CPC ..... *B66C 23/705* (2013.01); *B66C 23/70* (2013.01); *B66C 23/82* (2013.01)

(58) Field of Classification Search
CPC ..... B66C 23/705; B66C 23/70; B66C 23/82
See application file for complete search history.

(56) References Cited

U.S. PATENT DOCUMENTS 3,082,746 A 3/1963 Kerridge
4,011,699 A * 3/1977 Mickelson ..... B66C 23/705 52/115
4,150,754 A * 4/1979 Schmitt ..... B66C 23/54 212/300
4,354,607 A 10/1982 Hilgers
4,579,234 A * 4/1986 Delago ..... B66C 23/36 212/178
5,005,714 A * 4/1991 Kroll ..... B66C 23/36 212/178
5,035,337 A * 7/1991 Juergens ..... B66C 23/36 212/195
5,076,448 A * 12/1991 Ballard ..... B66C 23/48 212/261

(Continued)

FOREIGN PATENT DOCUMENTS

JP 2001-328793 A 11/2001

OTHER PUBLICATIONS

European Search Report for related European Application No. 16163185.8, dated Jul. 22, 2016.

(Continued)

*Primary Examiner* — Paola Agudelo
(74) *Attorney, Agent, or Firm* — Ramey & Schwaller, LLP; Craig Buschmann

(57) ABSTRACT

A system and method for retaining a linear actuator on a crane component such as a mast is disclosed. In the system a retaining mechanism is mounted on either a body of the linear actuator or the crane component and a catch is mounted to the other of the body or the crane component. Retraction of a rod of the linear actuator causes a cap on the rod to contact the retaining mechanism, which causes the retaining mechanism to move into a latched configuration securing the linear actuator.

7 Claims, 8 Drawing Sheets

(56) References Cited

U.S. PATENT DOCUMENTS

| | | | | |
|---|---|---|---|---|
| 5,240,129 | A * | 8/1993 | Schrick | B66C 23/82 212/175 |
| 5,484,069 | A * | 1/1996 | Lanning | B66C 23/36 212/175 |
| 6,481,587 | B2 * | 11/2002 | Higgins | B66C 23/705 212/231 |
| 6,527,131 | B1 * | 3/2003 | Brockelmann | B66C 23/705 212/292 |
| 9,598,875 | B1 * | 3/2017 | Bateman | E04H 12/182 |
| 2011/0031202 | A1 * | 2/2011 | Pech | B66C 23/76 212/178 |
| 2013/0300094 | A1 * | 11/2013 | Schurmann | B60S 9/12 280/763.1 |
| 2014/0251726 | A1 * | 9/2014 | Ditty | F16L 3/015 182/69.4 |
| 2016/0167934 | A1 * | 6/2016 | Moore | B66C 23/64 |

OTHER PUBLICATIONS

European Notice of Allowance and Allowed Application for related European Application No. 16163185.8, dated Apr. 18, 2018.
European Notice of Allowance and Allowed Application for related European Application No. 16163185.8, dated Oct. 4, 2018.

* cited by examiner

CYLINDER RETENTION DEVICE

RELATED APPLICATIONS

The present patent document is a divisional application of U.S. patent application Ser. No. 15/083,455, filed Mar. 29, 2016, which in turn claims the benefit of the filing date under 35 U.S.C. § 119(e) of Provisional U.S. Patent Application Ser. No. 62/140,852, filed Mar. 31, 2015, each of which are hereby incorporated by reference.

TECHNICAL FIELD

The disclosed subject matter relates to systems and methods for retaining a linear actuator on a crane. More particularly, the disclosed subject matter relates to systems and method for retaining a pivoting linear actuator mounted to a crane component such as a mast.

BACKGROUND

Lift cranes typically include a car body; ground engaging members elevating the car body off the ground; a rotating bed rotatably connected to the car body such that the rotating bed can swing with respect to the ground engaging members; and a boom pivotally mounted on the rotating bed, with a load hoist line extending there from. For mobile lift cranes, there are different types of moveable ground engaging members, most notably tires for truck mounted cranes, and crawlers. Typically mobile lift cranes include a counterweight to help balance the crane when the crane lifts a load. Typical cranes include a mast and a boom suspension that is used to change the angle of the boom and provide tension forces to offset the forces applied to the boom by the load on the load hoist line so that the boom can behave as a column member with only compressive forces acting through the length of the boom.

A typical crane is designed to be set up in multiple configurations. Each configuration typically has differing components and varying geometry between components in a given configuration. For example, a crane may be designed to be set up with different boom length configurations to optimize the capacity that the crane can handle, using only as long of a boom as is necessary for a particular lift operation that the crane is being set up for.

Since the crane will be used in various locations, it needs to be designed so that it can be transported from one job site to the next. This usually requires that the crane be dismantled into components that are of a size and weight that they can be transported by truck within highway transportation limits. The ease with which the crane can be dismantled and set up has an impact on the total cost of using the crane. Thus, to the extent that fewer man-hours are needed to set up the crane, there is a direct advantage to the crane owner or renter.

Because of the large size of the components, it may be necessary to utilize a separate crane to remove components from the truck and assemble a crane. Due to the time and expense of operating a second crane, systems and methods have been developed to minimize the use of a second crane. For example, it is common for one of the first components to be assembled to a crane to be a live mast. Or, it is possible that a crane be shipped with a live mast attached. Because the live mast is able to swing past the car body, it is possible to use the live mast as a temporary boom for self-assembly of the crane. However, at this stage of assembly, a crane typically does not have a functioning hoist for lifting operations. Instead, a linear actuator, such as a hydraulic cylinder may be attached to the mast for lifting loads. The linear actuator is attached at a top end of the mast in a rotating connection and allowed to hang freely. When the mast is at an angle of less than ninety degrees relative to the rear horizon of the crane, the linear actuator rests on the mast. As the mast rotates forward to an angle of greater than 90 degrees relative to the rear horizon, the linear actuator hangs from the mast at the rotating connection. With the linear actuator hanging down, it may then be used to lift objects, such as unassembled crane components.

Rather than manually assembling the linear actuator for assembly of the crane and then removing the linear actuator after the crane is assembled, the linear actuator is typically stowed on the mast when set-up is complete. Mobile cranes regularly move about construction sites: to orient the crane to a lift; to traverse a site between lift operations; and to maneuver in and around the site. While the crane is in motion, or during operation, it is important for the live mast mounted linear actuator to be restrained so that it does not swing freely, potentially distracting the operator, causing damage to the live mast, causing damage to the linear actuator, or damaging some other crane component.

This is known problem in the industry and there are a number of approaches used to catch, capture, latch, clamp, hook, or otherwise retain the linear actuator. Each approach has been generally successful in reducing the amount of time required for assembly relative to using a separate crane, or removing the linear actuator altogether. Past approaches have included running a strap over the actuator to hold it against the mast, pinning the actuator to the boom, and hooking an end of the linear actuator to the boom.

Historically, in order to stow an actuator, the live mast would need to be positioned at or near its horizontal position for a person to access the actuator. The person accessing the actuator would then attach a strap to hold the actuator in place or insert a pin to fasten the actuator to the live mast.

Moving the live mast back to the horizontal position requires additional time, so newer designs require that the live mast only be slightly less than vertical. However, stowing the actuator with the live mast in a near vertical position introduces other potential problems. For example, if a person needs to manually retain the actuator through a strap or a pin, they will need to be positioned high enough to reach the actuator, which would ether require a separate lift, or a way for a person to climb to the actuator. Both present potential safety issues and take additional time. Attempts to eliminate the need for a person to access the actuator have been largely unsuccessful to date, as they are either complicated, or are unreliable in operation, often requiring a person to guide the actuator.

It would be beneficial to develop a retaining mechanism that would allow crane setup times to be reduced even further, while maintaining the strength and durability needed for retaining a linear actuator on a crane mast.

BRIEF SUMMARY

In one aspect, a longitudinally telescoping actuator is disclosed. The longitudinally telescoping actuator includes a body, a rod, a pin holder, a pin, and an arm. The body has a first body end and a second body end opposite the first end. The rod has a first rod end slidably disposed within the body and a second rod end extending from the second body end, and a first lateral extent. The second rod end has a cap with a second lateral extent. The pin holder is coupled to the body near the second body end. The pin is slidably disposed within the pin holder and is biased to a position with a portion of the pin extending beyond the second body end. The arm extends laterally from the pin to a lateral location between first and second extent.

In some embodiments, the body is a hydraulic cylinder and the rod is a hydraulic cylinder rod. In some embodiments, the first lateral extent is an outer diameter of the hydraulic cylinder rod.

In some embodiments, the arm is a lever coupled to the pin and a wear pad coupled to the lever, and the wear pad contacts the cylinder rod.

In some embodiments, a spring bias the pin to the position with a portion of the pin extending beyond the second body end.

In some embodiments, the first body end includes a connector having an axis of rotation perpendicular to a longitudinal axis of the body.

In another aspect a mast assembly for a crane is disclosed. The mast assembly includes a mast having a base with a first rotating connector, a top opposite the base, and a catch between the base and the top. A hydraulic actuator comprising a cylinder rotatably coupled to the mast, a rod extending from the cylinder, and a cap coupled to the rod, the cap having a lateral extent greater than a lateral extent of the rod; a retaining mechanism is coupled to the cylinder, the retaining mechanism comprising a first portion disposed along the rod between the lateral extent of the rod and the lateral extent of the cap and a second portion configured to latch with the catch, wherein the retaining mechanism has a non-latching configuration with the rod extended and the cap not engaging the first portion, and a latching configuration with the rod retracted and engaging the first portion, wherein the retaining mechanism is moved from the non-latching configuration to the latching configuration by contact with the cap.

In some embodiments, the first portion of the retaining mechanism comprises an arm extending laterally, and the second portion comprises a pin slidably coupled to the cylinder and having a pin axis parallel to an axis of the cylinder. In some embodiments, the arm comprises a wear pad in contact with the rod.

In some embodiments, the catch is a longitudinal member orientated perpendicular to the cylinder axis and between the second portion and the cylinder with the retaining mechanism in the latched configuration. In some embodiments, the retaining mechanism is self-biased to the non-latching configuration. In some embodiments, to the latching configuration in response to contact with the rod end.

In another aspect, a method for retaining an assist hydraulic cylinder coupled to a mast is discloses. In the method, a live mast having an assist hydraulic cylinder is positioned to have a minimum angle less than ninety degrees relative to the horizon, with a rod extended from the hydraulic cylinder; the rod is retracted until a rod end contacts a latching mechanism; and the rod is further retracting the rod end causing the latching mechanism to engage with a catch coupled to the live mast. In some embodiments, the 1*a* mechanism to engage with a catch comprising moving a pin parallel to the cylinder to position the catch between a portion of the pin and a portion of the cylinder.

In another aspect, a mast assembly for a crane is disclosed. The mast assembly includes: a mast having a base with a first rotating connector and a top opposite the base; a hydraulic actuator comprising a cylinder rotatably coupled to the mast, a catch coupled to the cylinder, a rod extending from the cylinder, and a cap coupled to the rod; and a retaining mechanism coupled to the mast, the retaining mechanism comprising a first portion extending away from the mast and a second portion configured to latch with the catch, wherein the retaining mechanism has a non-latching configuration with the rod extended and the cap not engaging the first portion, and a latching configuration with the rod retracted and engaging the first portion.

DETAILED DESCRIPTION

In the following passages, different embodiments are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Figure 1:
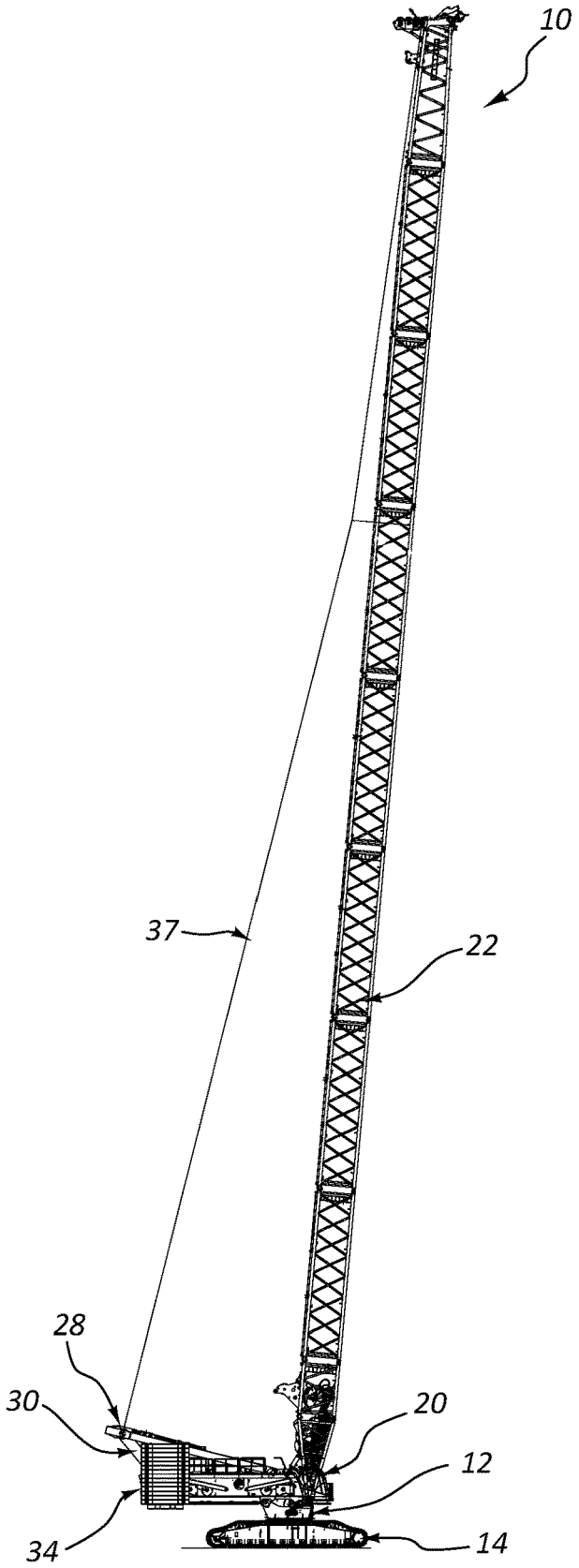
FIG. 1 illustrates a side view of an embodiment of a mobile lift crane having a live mast.

While the disclosed subject matter (or various disclosed embodiments) will have applicability to many types of cranes, it (they) will be described in connection with a mobile lift crane 10, shown in an operational configuration with a live mast in FIG. 1. The mobile lift crane 10 includes lower works, also referred to as a car body 12, and moveable ground engaging members in the form of crawlers 14. Of course additional crawlers than those shown can be used, as well as other types of ground engaging members, such as tires.

A rotating bed 20 is mounted to the car body 12 with a slewing ring, such that the rotating bed 20 can swing about an axis with respect to the ground engaging members 14. The rotating bed 20 supports a boom 22 pivotally mounted on a front portion of the rotating bed 20; a live mast 28 mounted at its first end on the rotating bed 20, boom hoist rigging 30 connected to the live mast 28 adjacent a second end of the live mast 28; and a moveable counterweight unit 34. In FIG. 1, the counterweight unit 34 has multiple stacks of individual counterweight members on a support member. In other embodiments, the counterweight unit may have a single counter weight.

Boom hoist rigging 30 between the top of the live mast 28 and the rotating bed is used to control the angle of the live mast 28. A suspension assembly 37 between the top of the live mast 28 and the boom 22 supports the boom. A load hoist line (not shown) is trained over a pulley on the boom 22, supporting a hook (not shown) at a first end. At a second end, the load hoist line is wound on a first main load hoist drum (not shown) connected to the rotating bed 20. The rotating bed 20 includes other elements commonly found on a mobile lift crane 10, such as an operator's cab and a hoist drum for the boom hoist rigging 30.

The boom hoist rigging 30 includes a boom hoist line in the form of wire rope wound on a boom hoist drum, and reeved through sheaves on the live mast 28. The live mast 28 is connected to the rotating bed 20 though the boom hoist rigging 30 and to the boom through the suspension assembly 37. This arrangement allows rotation of the boom hoist drum to change the amount of boom hoist line between the live mast 28 and the rotating bed 20 changing the mast angle and thereby changing the boom angle through the suspension assembly 37.

Figure 2:
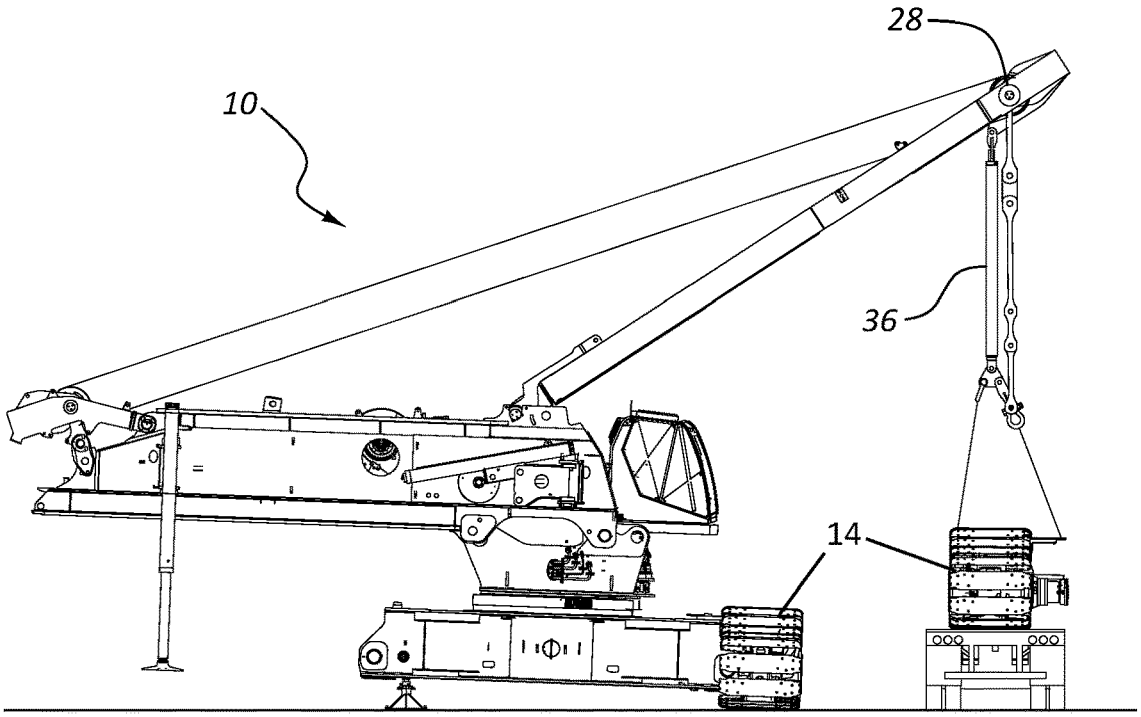
FIG. 2 illustrates a mobile lift crane assembling a crawler track to a car body.

FIG. 2 illustrates a partially assembled mobile crane 10 utilizing it's live mast 28 as a boom with a hydraulic cylinder 36 as a lifting component. The mobile lift crane of FIG. 2 has a single crawler 14 attached to the car body 12. The live mast and the hydraulic cylinder are being used to lift a second crawler to position it for installation on the car body.

Figure 3:
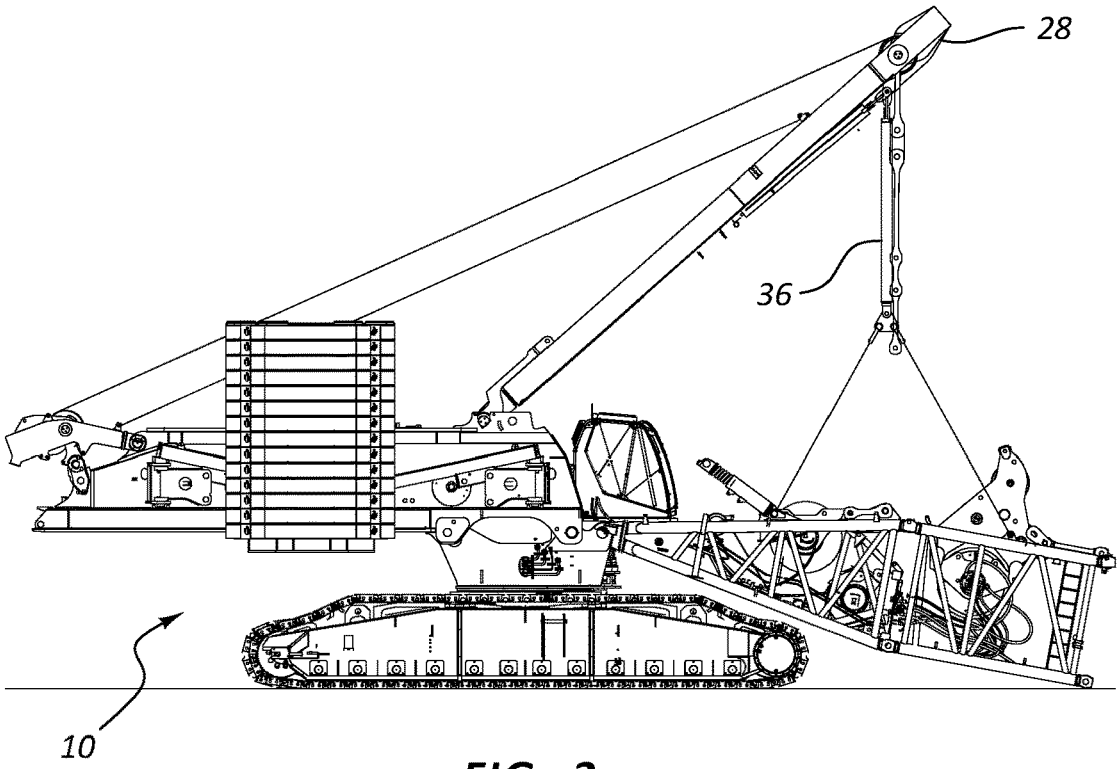
FIG. 3 illustrates a mobile lift crane utilizing a linear actuator for assistance in setting up a boom.

FIG. 3 illustrates a partially assembled mobile crane 10 utilizing its live mast as a boom with the hydraulic cylinder as a lifting component for set up of a boom. The hydraulic cylinder is coupled to the boom and lifts it into position for attachment to the upper works of the mobile lift crane. Once assembled, the cylinder should be stowed/secured so that it does not interfere with normal operation of the boom.

Figure 4:
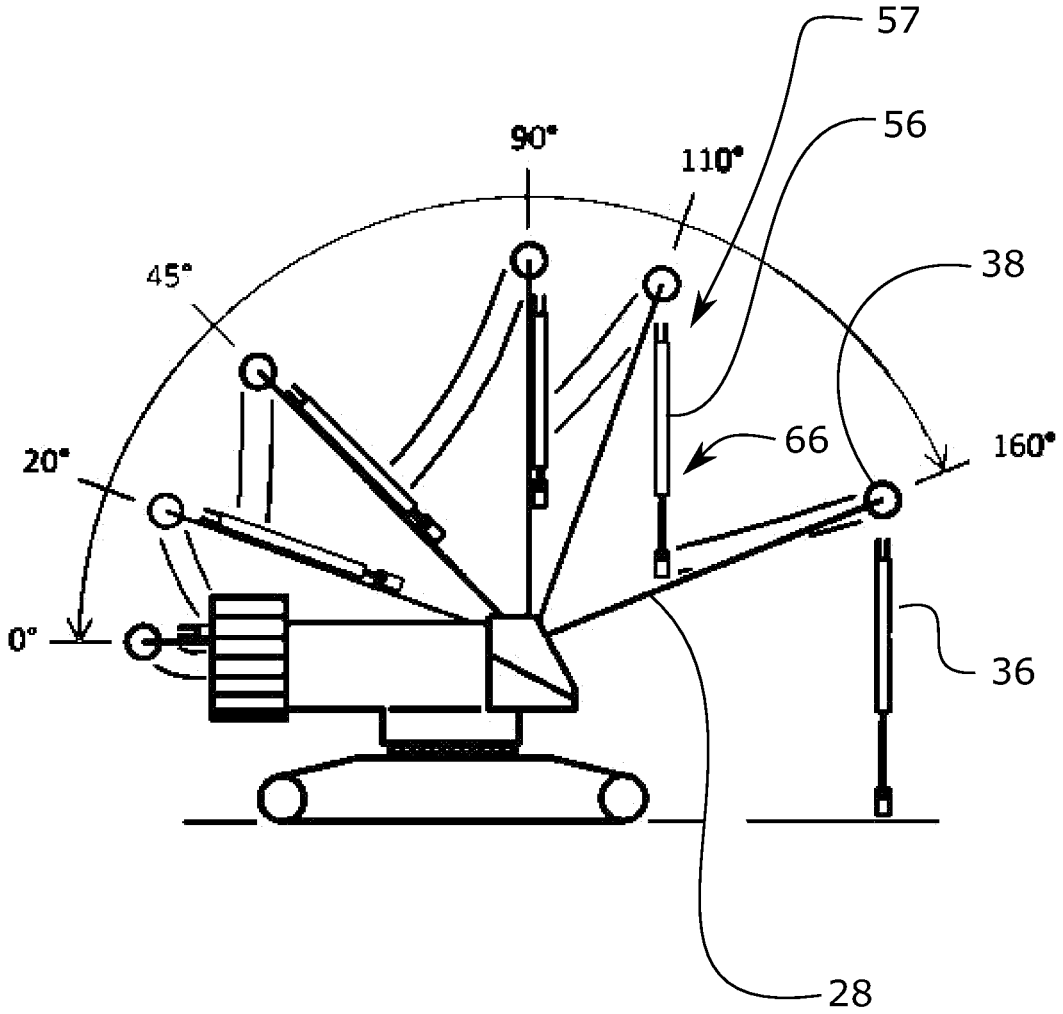
FIG. 4 illustrates a schematic of a live mast on a mobile crane illustrating its various operating angles.

FIG. 4 illustrates a live mast 28 having a linear actuator in the form of hydraulic cylinder 36. The live mast 28 is shown in six positions ranging from 0 degrees to 160 degrees relative to the rear horizontal as shown. The hydraulic cylinder 36 is typically mounted pivotably, near the top of the live mast (more or less about the centerline of sheaves 38) and is positioned by gravity as the live mast 28 is moved through its working range. Between the angles of 0 to 90 degrees, the hydraulic cylinder 36 rests against the live mast 28 due to gravity and it is only when the live mast 28 reaches 90 degrees that the hydraulic cylinder 36 swings free from the live mast 28 and may be used in assembly of the mobile crane 10.

Figure 5:
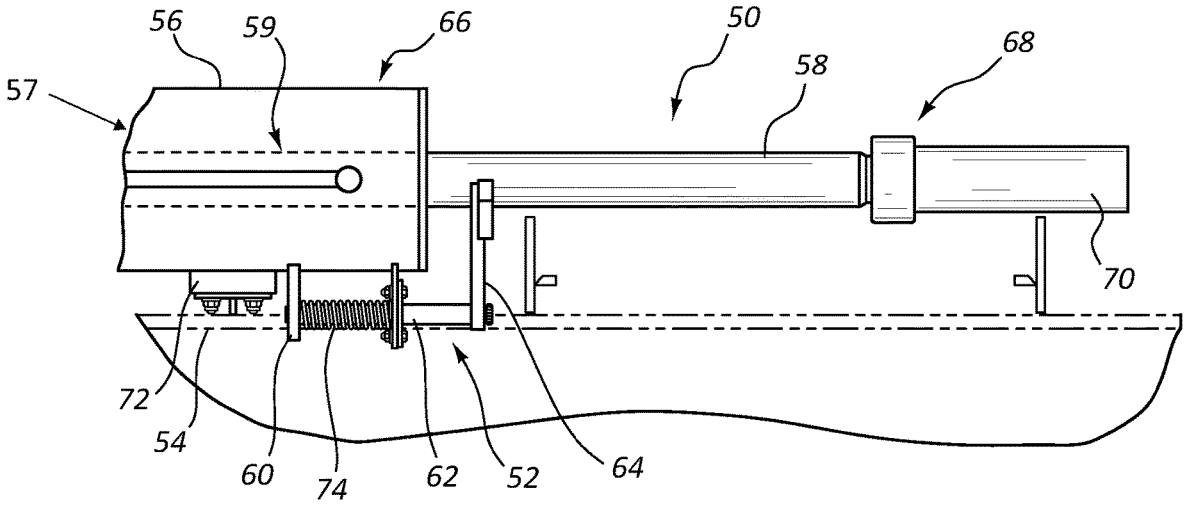
FIG. 5 illustrates an embodiment of a linear actuator and a live mast.
Figure 6:
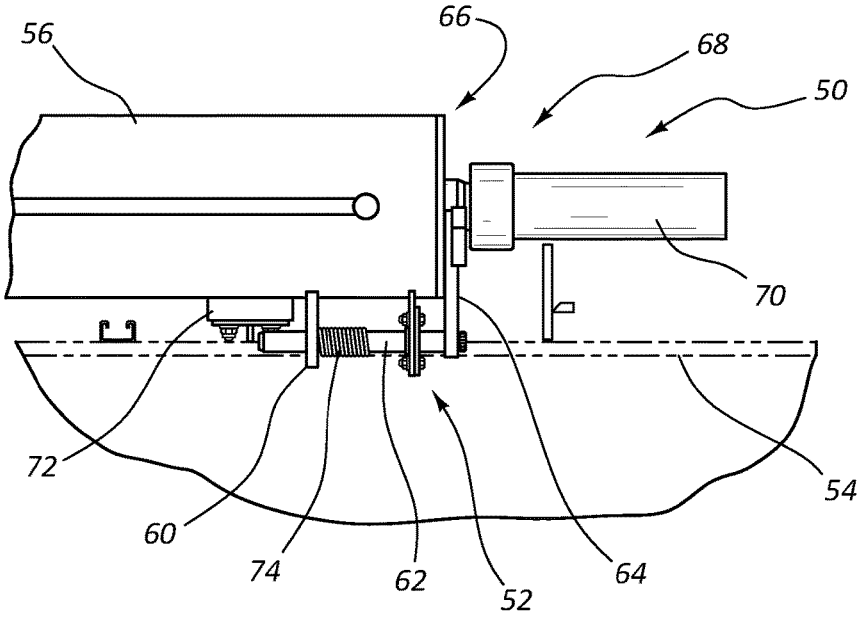
FIG. 6 illustrates the linear actuator of FIG. 5 being retained on the live mast.

FIG. 5 illustrates an embodiment of a linear actuator 50 having a retaining mechanism 52 for retaining the linear actuator 52 on a crane component 54. The linear actuator 50 of FIG. 5 includes a body 56, a rod 58, a pin holder 60, a pin 62, and an arm 64. FIG. 6 illustrates the linear actuator 50 of FIG. 5 with the rod 58 retracted, causing the retaining mechanism 52 to retain the linear actuator 50.

The body 56 has a first end 57 that mounts to a crane component, 54 such as live mast 28 in a rotating connection, as shown in FIG. 4. One example of a rotating connection is a pinned connection, as commonly used by those of ordinary skill in the art. The rotating connection rotates in an axis that is perpendicular to a longitudinal axis of the body 56.

The rod 58 extends from a second end 66 of the body 56 opposite the first end of the body 56. The rod 58 has a first portion 59 slidably disposed within the body 56 and a second portion 68 that extends from second end 66 of the body 56. The second portion 68 of the rod 58 has a cap 70, which may be coupled to a second crane component to effectuate movement of the second crane component relative to a crane component secured to the first end of the body 56. The cap 70 has a lateral extent that is greater than a lateral extent of the rod 58. In one embodiment, the rod 58 is circular in cross section, and the cap 70 is circular in cross section, and a radius of the cap 70 is greater than a radius of the rod 58. In another embodiment, the rod 58 has a circular cross section and the cap 70 has square cross section. In such an embodiment, a side of square cross section has a length greater than a diameter of the rod 58.

The pin holder 60 is coupled to the body 56 near the second end 66 of the body 56. The pin holder 60 holds a pin 62 slidably disposed in the pin holder 60 such that it may be moved in a longitudinal direction parallel to the rod 58. The pin 62 is biased to a position in which a portion of the pin 62 extends beyond the second end 66 of the body 56. The bias is provided by a spring 74 in the embodiment of FIGS. 5 and 6, but in other embodiments the bias may be provided by gravity or other means. The arm 64 extends laterally from the pin 62 to a lateral location between the lateral extent of the rod 58 and the lateral extent of the cap 70. As shown in FIG. 6, movement of the cap towards the body contacts the arm moving the pin against the bias and where the bias comprises a spring 74, compressing the spring.

FIG. 6 illustrates the linear actuator 50 with the pin 62 being moved against the bias by contact with the cap 70. The pin 62 extends from the pin holder 60 on an end opposite the arm 64, and extends into a catch 72 on the crane component 54, retaining the body 56 from moving away from the component.

Figure 7:
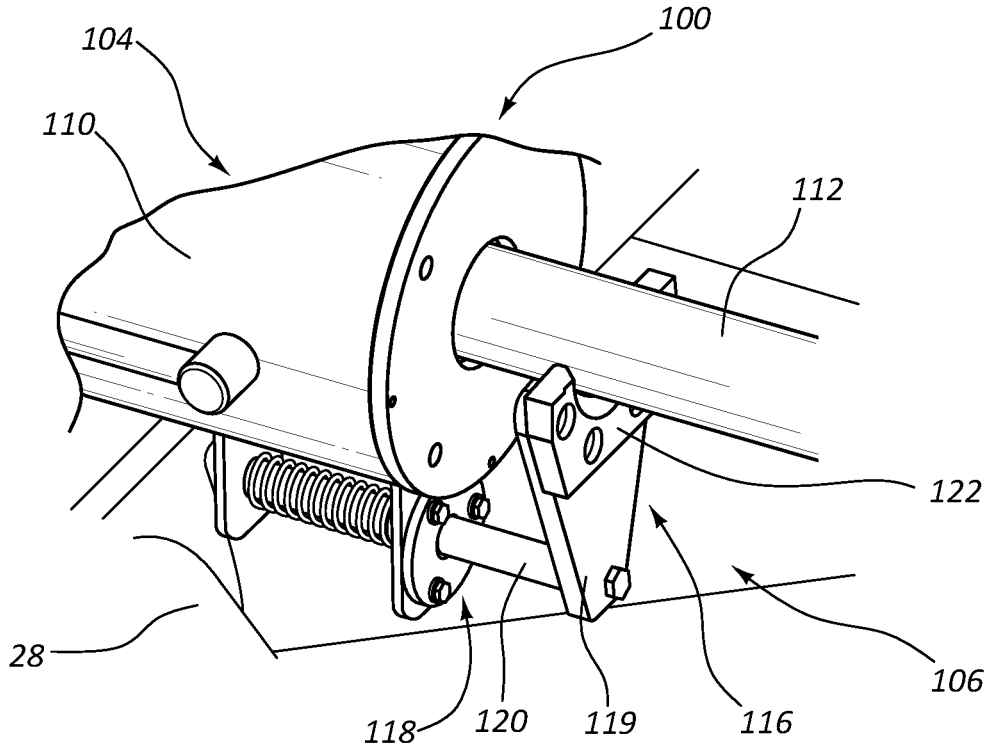
FIG. 7 illustrates an embodiment of a linear actuator in an unlatched state.
Figure 8:
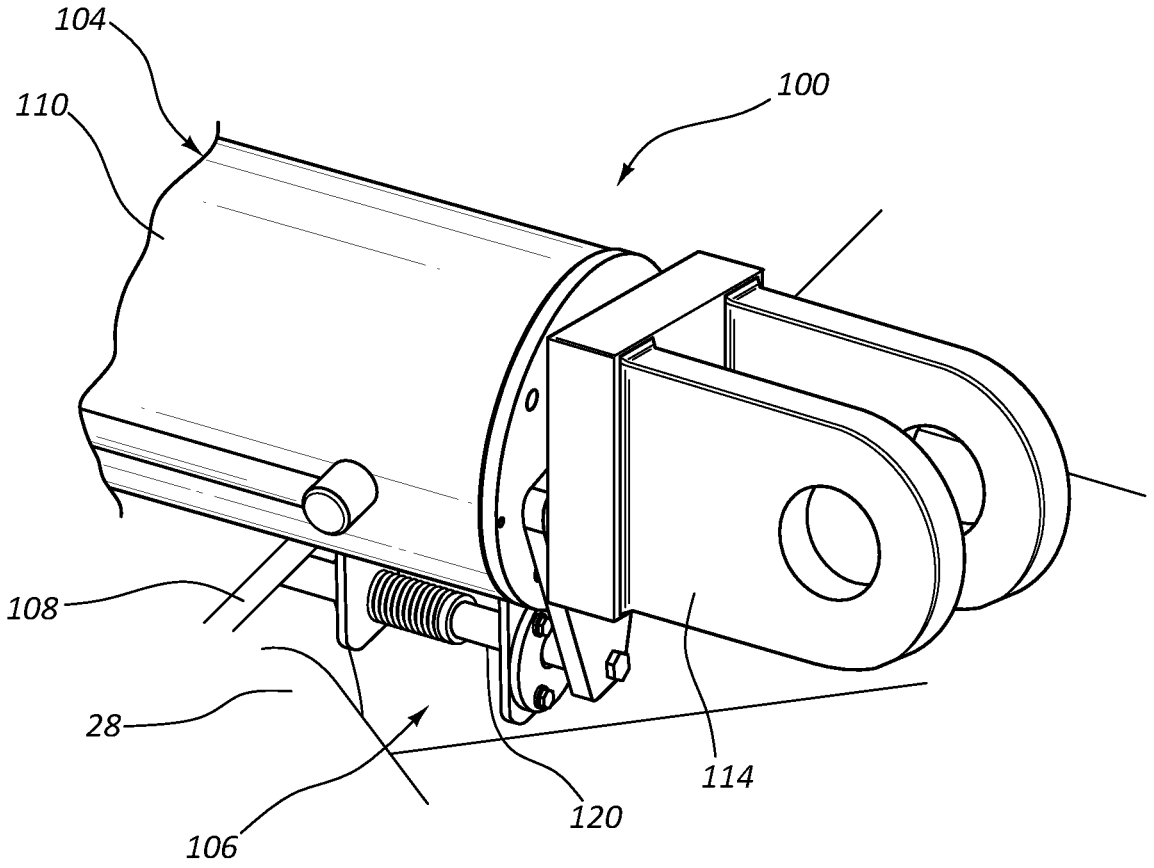
FIG. 8 illustrates the embodiment of FIG. 7 in a latched state.
Figure 9:
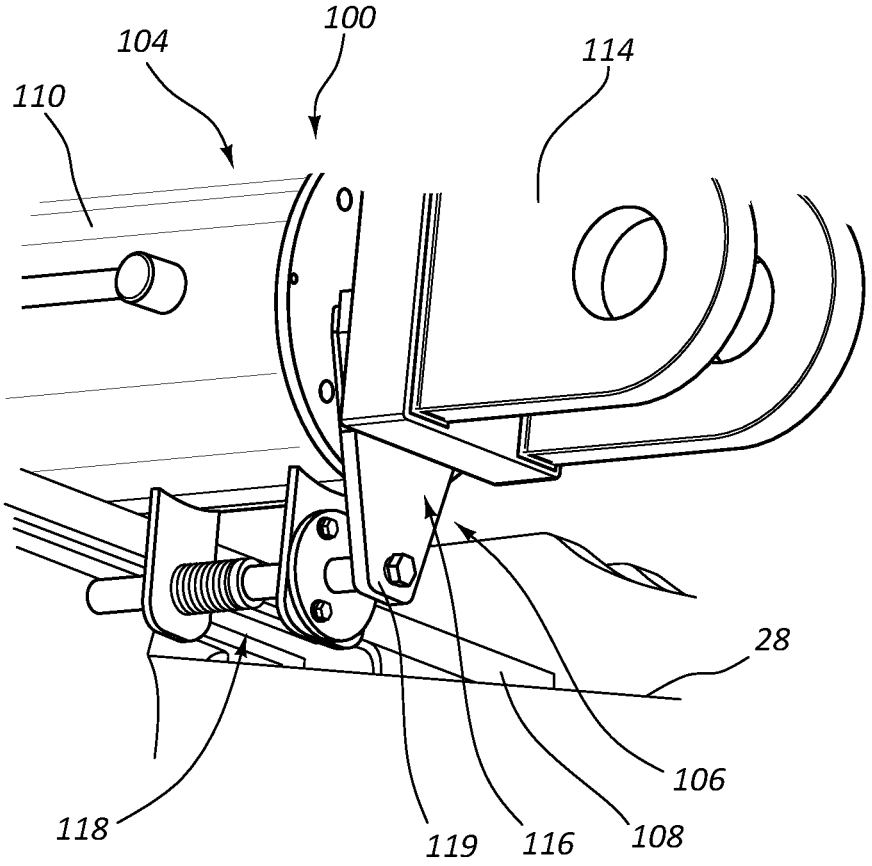
FIG. 9 illustrates the embodiment of FIG. 7 in a latched state.

FIG. 7 illustrates a detailed view of a mast assembly 100 having a mast 28, a hydraulic actuator 104, and a retaining mechanism 106. The entire mast 28 is illustrated in FIG. 2 and FIG. 3, while FIGS. 7, 8, and 9 illustrate a detailed view of the mast 28 interacting with a retaining mechanism 106. FIG. 7 illustrates the retaining mechanism 106 in an unactuated state, while FIG. 8 and FIG. 9 illustrate the retaining mechanism 106 in an actuated state.

The mast 28 has a base with a rotating connector for connection to the upper works of the mobile crane. Opposite the base is the top of the mast 28 and a catch 108 is positioned between the base and the top. The hydraulic actuator 104 has a cylinder 110 in a rotatable connection to the mast 28, a rod 112 extending from the cylinder 110, and a cap 114 coupled to the rod 112. The cap 114 has a lateral extent greater than a lateral extent of the rod 112. The retaining mechanism 106 is coupled to the cylinder 110 and includes a portion 116 positioned along the rod 112 between the lateral extent of the rod 112 and the lateral extent of the cap 114. A second portion 118 of the retaining mechanism is configured to latch with the catch 108 on the mast 28. The retaining mechanism 106 has a first configuration, shown in FIG. 7 in which the rod 112 is extended from the cylinder 110 and the cap 114 not does not engage the first portion 116 of the retaining mechanism 106. In a second configuration, shown in FIG. 8 and FIG. 9, the rod 112 is retracted and the cap 114 engages the first portion 116 of the retaining mechanism 106 moving the retaining mechanism 106 from the non-latching configuration of FIG. 7 to the latching configuration of FIG. 8 and FIG. 9. The retaining mechanism 106 is biased to the non-latching configuration, such that absent contact with the cap 114, the retaining mechanism 106 is in the non-latching configuration.

The first portion 116 of the retaining mechanism 106 may include an arm 119 that extends laterally from the second portion 118. The second portion 118 may be in the form of a pin 120. The pin 120 is slidably coupled to the cylinder 110 and has an axis parallel to an axis of the cylinder 110. The arm 118 may include a wear pad 122 in contact with the rod 112 made from a low friction, durable material such as nylon.

The catch 108 in the embodiment of FIGS. 7-9 is a lateral plate, but other catches are possible such as a slot or bar.

Figure 10:
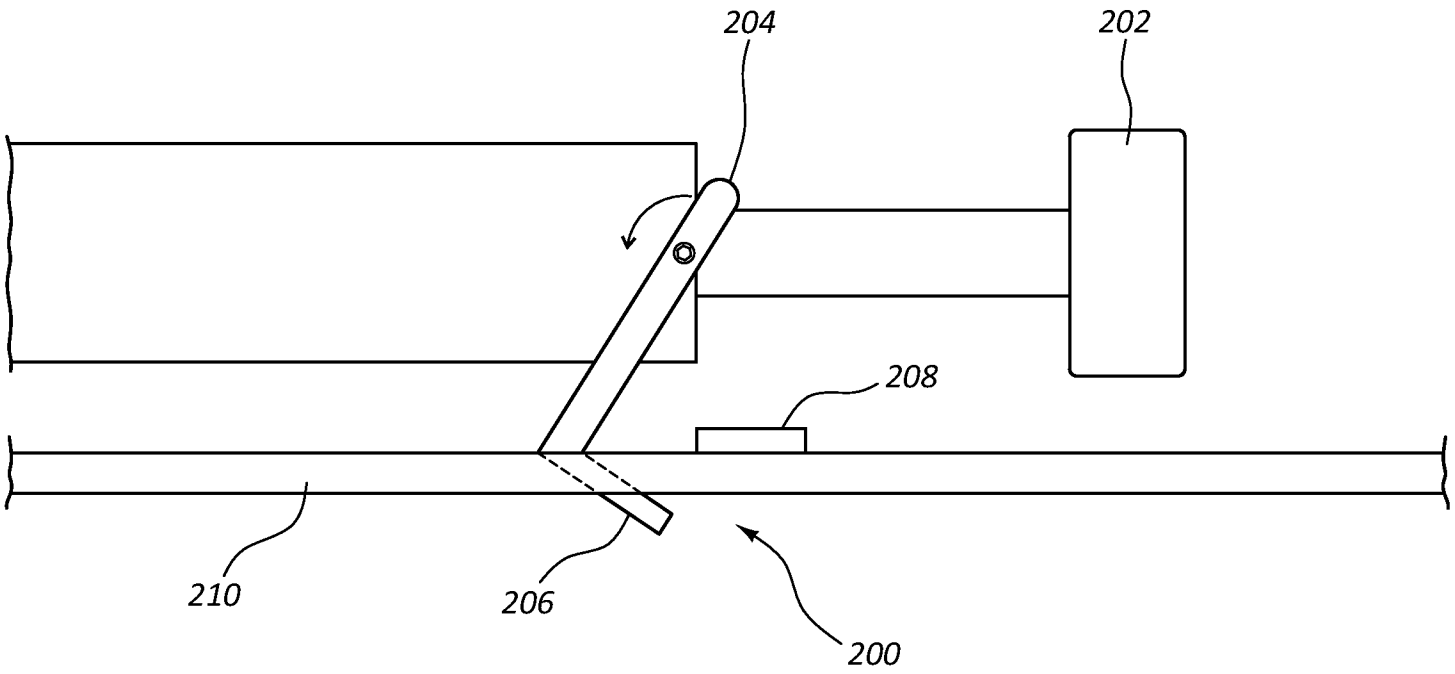
FIG. 10 illustrates another embodiment of a linear actuator and a rotary retaining mechanism.

FIG. 10 illustrates an embodiment of latching mechanism 200 that uses a rotary motion for moving between a latched configuration and an unlatched configuration. Contact between the cap 202 and an arm 204 causes the latching mechanism 200 to rotate positioning a second portion 206 of the latching mechanism 200 under a latch 208 on the mast 210. When the cap 202 is extended as shown, a self-bias of the retaining mechanism 204 causes the retaining mechanism 200 to rotate the second portion 206 away from the latch 208, thereby unlatching the retaining mechanism 200.

Figure 11:
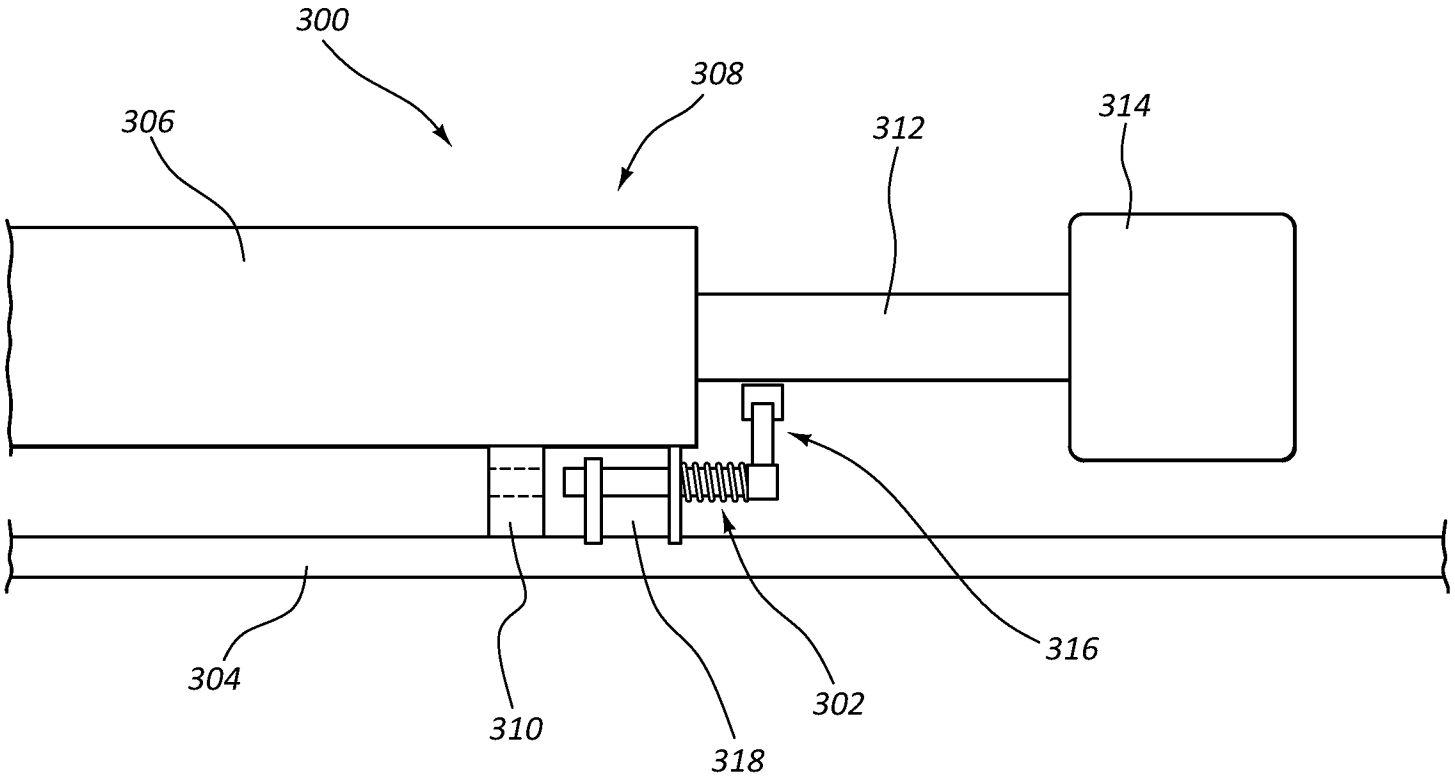
FIG. 11 illustrates another embodiment of a linear actuator and a retaining mechanism.

FIG. 11 illustrates an embodiment of a mast assembly 300 with a retaining mechanism 302 coupled to a mast 304, rather than to a cylinder 306 as described previously. A hydraulic actuator 308 includes a cylinder 306 rotatably coupled to the mast 304, a catch 310 coupled to the cylinder 306, a rod 312 extending from the cylinder 306, and a cap 314 coupled to the rod 312. The retaining mechanism 302 is coupled to the mast 304 and includes a first portion 316 extending away from the mast 304 and a second portion 318 configured to latch with the catch 310. The retaining mechanism 318 has a non-latching configuration with the rod 312 extended and the cap 314 not engaging the first portion 316, and a latching configuration with the rod 312 retracted and engaging the first portion 316.

Embodiments of the disclosed subject matter are further directed to a method for retaining a hydraulic to a mast. In the method a live mast having an assist hydraulic cylinder is positioned to have a minimum angle less than ninety degrees relative to the horizon and with a rod extended from the hydraulic cylinder. The rod is then retracted until a rod end contacts a latching mechanism. The rod is then further retracting causing the latching mechanism to engage with a catch coupled to the live mast. In some embodiments, causing the latching mechanism to engage with a catch includes moving a pin parallel to the cylinder to position the catch between a portion of the pin and a portion of the cylinder.

It should be understood that various changes and modifications to the presently preferred embodiments described herein will be apparent to those skilled in the art. For example, instead of a single pin being used multiple pins may be used to engage the catch in multiple locations. A single arm could actuate the multiple pins, or in some embodiments each could have their own extending towards the rod. Additionally, while not described in detail, one of ordinary skill in the art will recognize that the different embodiments may be used in combination with one another. For example, the rotary mechanism of FIG. 10 may be utilized as a mast mounted retention mechanism similar to FIG. 11.

The invention claimed is:

1. A mast assembly for a crane, the mast assembly comprising:

a mast having a base with a first rotating connector, a top opposite the base, and a catch between the base and the top;

a hydraulic actuator comprising a cylinder rotatably coupled to the mast, a rod extending from the cylinder, and a cap coupled to the rod, the cap having a lateral extent greater than a lateral extent of the rod;

a retaining mechanism coupled to the cylinder, the retaining mechanism comprising a first portion disposed along the rod between the lateral extent of the rod and the lateral extent of the cap and a second portion configured to latch with the catch, wherein the retaining mechanism has a non-latching configuration with the rod extended and the cap not engaging the first portion, and a latching configuration with the rod retracted and engaging the first portion, wherein the retaining mechanism is moved from the non-latching configuration to the latching configuration by contact with the cap.

2. The mast assembly of claim 1, wherein the first portion of the retaining mechanism comprises an arm extending laterally, and the second portion comprises a pin slidably coupled to the cylinder and having a pin axis parallel to an axis of the cylinder.

3. The mast assembly of claim 2, wherein the arm comprises a wear pad in contact with the rod.

4. The mast assembly of claim 2, wherein the catch comprises a longitudinal member orientated perpendicular to the cylinder axis and between the second portion and the cylinder with the retaining mechanism in the latched configuration.

5. The mast assembly of claim 1, wherein the retaining mechanism is self-biased to the non-latching configuration.

6. The mast assembly of claim 1, wherein the retaining mechanism rotates from the non-latching configuration to the latching configuration in response to contact with the rod end.

7. A mast assembly for a crane, comprising:

a mast having a base with a first rotating connector and a top opposite the base;

a hydraulic actuator comprising a cylinder rotatably coupled to the mast, a catch coupled to the cylinder, a rod extending from the cylinder, and a cap coupled to the rod; and a retaining mechanism coupled to the mast, the retaining mechanism comprising a first portion extending away from the mast and a second portion configured to latch with the catch, wherein the retaining mechanism has a non-latching configuration with the rod extended and the cap not engaging the first portion, and a latching configuration with the rod retracted and engaging the first portion.

* * * * *